US010878790B1

(12) United States Patent
Geske et al.

(10) Patent No.: US 10,878,790 B1
(45) Date of Patent: Dec. 29, 2020

(54) DEVICE AND METHOD FOR AMPLITUDE MODULATED OPTICAL PICKUP FOR A STRINGED INSTRUMENT

(71) Applicant: Aspire Precision Instruments, LLC, Ventura, CA (US)

(72) Inventors: Jonathan C. Geske, Ventura, CA (US); Andrew D. Hood, Ventura, CA (US)

(73) Assignee: Aspire Precision Instruments, LLC, Ventura, CA (US)

( * ) Notice: Subject to any disclaimer, the term of this patent is extended or adjusted under 35 U.S.C. 154(b) by 0 days.

(21) Appl. No.: 16/818,866

(22) Filed: Mar. 13, 2020

(51) Int. Cl.
*G10H 3/06* (2006.01)
*G10H 3/18* (2006.01)

(52) U.S. Cl.
CPC ..... *G10H 3/06* (2013.01); *G10H 3/181* (2013.01); *G10H 2220/461* (2013.01)

(58) Field of Classification Search
CPC ..... G10H 3/06; G10H 3/181; G10H 2220/461
See application file for complete search history.

(56) References Cited

U.S. PATENT DOCUMENTS 3,694,559 A * 9/1972 Suzuki ..... G10H 1/0558 84/744
3,960,044 A * 6/1976 Nagai ..... G10H 1/0558 84/719
4,688,460 A * 8/1987 McCoy ..... G10H 3/181 84/724
4,730,050 A 3/1988 Bonanno
4,730,530 A * 3/1988 Bonanno ..... G10H 3/18 84/724
4,815,353 A * 3/1989 Christian ..... G10H 3/146 84/724
4,919,031 A * 4/1990 Matsumoto ..... G10H 1/342 84/601
5,012,086 A * 4/1991 Barnard ..... G01V 8/20 250/222.1
5,033,351 A * 7/1991 Nomura ..... G10H 1/342 84/646
5,040,447 A * 8/1991 Murata ..... G09B 15/003 84/477 R
5,140,887 A * 8/1992 Chapman ..... G10H 1/342 84/314 R (Continued)

*Primary Examiner* — Jeffrey Donels
(74) *Attorney, Agent, or Firm* — W. Eric Boyd, Esq.

(57) ABSTRACT

A device and method for an amplitude modulated optical pickup for a stringed instrument are disclosed. A first optical source comprising a first output signal comprising a first carrier frequency is provided and a first photodetector is in optical communication with the first optical source. A vibrating element such as a string on a musical instrument is disposed in an optical path between the first optical source and the first photodetector whereby a vibration of the element varies and modulates an amplitude of the first output signal received by the photodetector that is proportional to an element vibration amplitude and is at the same frequency as the element vibration frequency. An amplitude modulated (AM) photodetector signal output is generated from the first photodetector. The resultant signal is then demodulated with appropriate circuitry to produce a substantially noise free electronic signal representative of the element vibration frequency.

18 Claims, 12 Drawing Sheets

(56) References Cited

U.S. PATENT DOCUMENTS

| | | | | | |
|---|---|---|---|---|---|
| 5,237,126 | A * | 8/1993 | Curtis | G01V 8/20 | 84/724 |
| 5,396,025 | A * | 3/1995 | Tamura | G10H 1/12 | 84/736 |
| 5,398,585 | A * | 3/1995 | Starr | G10H 1/342 | 84/646 |
| 7,671,269 | B1 * | 3/2010 | Krueger | G10H 1/0008 | 84/724 |
| 7,897,866 | B2 * | 3/2011 | Sullivan | G10H 1/342 | 84/724 |
| 2010/0083808 | A1 * | 4/2010 | Sullivan | G10H 1/342 | 84/315 |
| 2011/0061517 | A1 * | 3/2011 | Haddad | G10H 3/188 | 84/724 |
| 2012/0234161 | A1 * | 9/2012 | Haddad | G10H 3/06 | 84/724 |
| 2014/0076127 | A1 * | 3/2014 | Haddad | G10H 3/06 | 84/724 |

* cited by examiner

DEVICE AND METHOD FOR AMPLITUDE MODULATED OPTICAL PICKUP FOR A STRINGED INSTRUMENT

CROSS REFERENCE TO RELATED APPLICATIONS

N/A

FIELD OF THE INVENTION

The invention generally relates to signal or sound reproduction of a vibrating element which may comprise the resonant vibration of a string on a stringed instrument and related signal processing. More specifically, embodiments of the invention relate to the use of an amplitude modulated optical pickup system to generate an electrical signal representative of a motion or sound generated by a vibrating or oscillating element such as a string of a musical instrument.

BACKGROUND OF THE INVENTION

Prior art optical pickups for musical instruments like bass guitars and guitars are susceptible to background light and electromagnetic interference that can cause unwanted optical signals to enter the front end of the photodetector of the optical pickup. This is because many sources of audio band noise exist or may be present in the environment around the pickup. Sources of such undesirable noise may include the modulation of modern commercial and residential energy-efficient LED lighting in the 2 kHz to 20 kHz range or may be introduced from optical flashes used in photography and other high intensity light sources.

Because optical pickups have historically used direct frequency translation from the string vibration of an instrument to generate the representative electrical output signal, there are few options available to filter out undesirable background light noise, in part because background light noise is largely indistinguishable from the desired audio signal that a user is concerned with.

A non-limiting example of a prior art optical pickup system is taught in U.S. Pat. No. 5,237,126, "Optoelectric Transducer System for Stringed Instruments", the entirety of which is incorporated by reference herein.

BRIEF SUMMARY OF THE INVENTION

A device and method for an amplitude modulated optical pickup for a stringed instrument are disclosed. A first optical source comprising a first output signal comprising a first carrier frequency is provided and a first photodetector is in transmissive or reflective optical communication with the first optical source.

A vibrating element such as a string on a musical instrument is disposed in an optical path between the first optical source and the first photodetector whereby a vibration of the element varies and modulates an amplitude of the first output signal received by the photodetector that is proportional to an element vibration amplitude and is at the same frequency as the element vibration frequency. An amplitude modulated (AM) photodetector signal output is thus generated from the first photodetector. The resultant signal is then demodulated with appropriate circuitry to produce a substantially noise free electronic signal representative of the element vibration frequency and amplitude.

In a first aspect of the invention, an amplitude-modulated (AM) optical pickup system is provided comprising an optical source comprising an optical signal having a carrier frequency and a photodetector in optical communication with the optical source. A vibrating element such as a string of a musical instrument is disposed in a reflective or direct transmissive optical path between the optical source and the photodetector whereby an element vibration varies an intensity and modulates an amplitude of the optical signal received by the photodetector proportional to an element vibration frequency whereby an amplitude modulated (AM) photodetector signal is generated by the photodetector.

In a second aspect of the invention, the amplitude-modulated (AM) optical pickup system may comprise circuitry configured to receive and demodulate the amplitude modulated (AM) photodetector signal to provide an output signal representative of the frequency of the vibrating element.

In a third aspect of the invention, the amplitude-modulated (AM) optical pickup system may be configured wherein the optical signal is incident upon the vibrating element and is reflected on the photodetector whereby an intensity of the reflected optical signal received by the photodetector is varied proportional to the element vibration frequency.

In a fourth aspect of the invention, the amplitude-modulated (AM) optical pickup system may be configured wherein the optical signal is transmitted directly from the optical source to the photodetector whereby an intensity of the optical signal is varied proportional to a vibration frequency of the vibrating element disposed in the optical path.

In a fifth aspect of the invention, the optical source may comprise a light emitting structure, a light emitting diode or a laser element.

In a sixth aspect of the invention, the amplitude-modulated (AM) optical pickup system may comprise a plurality of light emitting structures, light emitting diodes or laser elements.

In a seventh aspect of the invention, the amplitude-modulated (AM) optical pickup system may comprise a plurality of photodetectors.

In an eighth aspect of the invention, the optical source may comprises a coherent light source.

In a ninth aspect of the invention, the optical source may comprise a partially coherent or incoherent light source.

In a tenth aspect of the invention, the vibrating element may comprise a string, neck or body of a musical instrument.

In an eleventh aspect of the invention, a wavelength of the optical source may selected from the visible, near infrared or shortwave infrared electromagnetic spectrum.

In a twelfth aspect of the invention, the amplitude-modulated (AM) optical pickup system may comprise at least two photodetectors per vibrating element wherein a pair of optical signals are reflected from the vibrating element and are subtracted from each other to increase a modulation depth and to remove noise common to both signals.

In a thirteenth aspect of the invention, the amplitude-modulated (AM) optical pickup system may comprise at least two photodetectors per vibrating element wherein an optical signal is transmitted from an optical source to a pair of photodetectors and a pair of respective amplitude modulated (AM) photodetector signal output signals from each photodetector are subtracted from each other to increase a modulation depth and to remove noise common to both signals.

In a fourteenth aspect of the invention, a plurality of amplitude modulated (AM) photodetector signal output signals from multiple photodetectors may be summed prior to amplification and demultiplexing/modulation.

In a fifteenth aspect of the invention, a first light source may comprise a first carrier frequency to modulate a first vibrating element and a second light source may comprise a second carrier frequency that is different from the first carrier frequency to modulate an second vibrating element whereby an optical signal crosstalk is reduced.

In a sixteenth aspect of the invention, a predetermined geometry of a face, input or lens of the photodetector varies an optical energy sensitivity over the optical input surface such as by having a triangular, angular or varied light receiving surface relative to the incident optical source beam.

In a seventeenth aspect of the invention, a method is provided for producing an output signal representative of the frequency of a vibrating element comprising the steps of configuring a photodetector to receive an optical signal having a carrier frequency from an optical source, disposing a vibrating element in an optical path between the photodetector and the optical source whereby a vibration of the vibrating element modulates an amplitude of the optical signal proportional to an element vibration frequency to define an amplitude modulated (AM) photodetector signal.

In an eighteenth aspect of the invention, the method may further comprise the step of demodulating the amplitude modulated (AM) photodetector signal to provide an output signal representative of the frequency of the vibrating element.

These and various additional aspects, embodiments and advantages of the present invention will become apparent to those of ordinary skill in the art upon review of the Detailed Description and any claims to follow.

While the claimed apparatus and method herein has or will be described for the sake of grammatical fluidity with functional explanations, it is to be understood that the claims, unless expressly formulated under 35 USC 112, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC 112, are to be accorded full statutory equivalents under 35 USC 112.

BRIEF DESCRIPTION OF THE DRAWINGS

Embodiments of the invention are illustrated by way of example and not by limitation in the figures of the accompanying drawings in which like references indicate similar elements.

Figure 1:
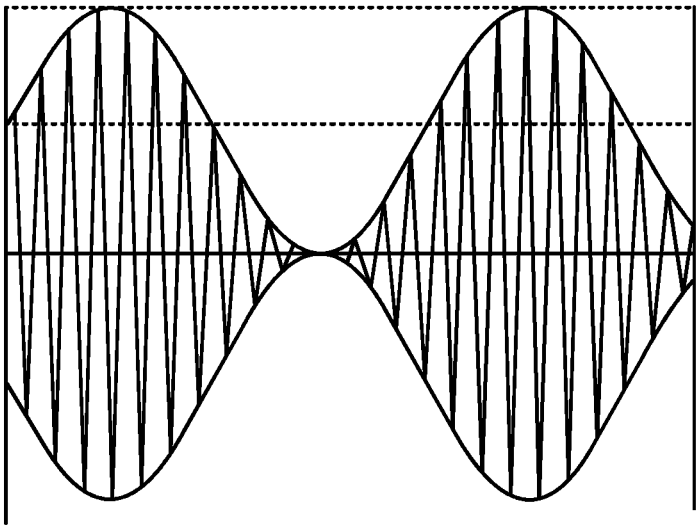
Prior Art FIG. 1
FIG. 1 depicts an exemplar amplitude modulated signal comprising a carrier signal having a carrier frequency with its amplitude being modulated by a modulation signal or source.

The invention and its various embodiments can now be better understood by turning to the following Detailed Description of the preferred embodiments which are presented as illustrated examples of the invention in any subsequent claims in any application claiming priority to this application. It is expressly understood that the invention as defined by such claims may be broader than the illustrated embodiments described below.

DETAILED DESCRIPTION OF THE INVENTION

The present invention takes advantage of a novel technological approach to eliminate or greatly reduce unwanted electrical background noise and light noise from the sound produced by an optical pickup of a stringed musical instrument or other audio detection device.

Various embodiments and aspects of the invention are described with reference to details discussed below and the accompanying drawings illustrate certain of the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present invention.

Reference in the specification to "one embodiment", "an embodiment" or "some embodiments" means that a particular feature, structure, or characteristic described in conjunction with the embodiment can be included in at least one embodiment of the invention. The appearances of the phrase "in one embodiment" in various places in the specification do not necessarily all refer to the same embodiment.

The device and method described herein take advantage of the principles of amplitude modulation (AM) and demodulation to shift desired audio signals out of the band that comprises undesirable background noise. In this manner, the unwanted background noise does not appear, or is greatly attenuated, in the final output signal generated by the optical pickup system of the instant invention.

Background noise as referred to herein may be defined as any undesired electromagnetic interference that exists in the audio frequencies from 0-25,000 Hz that is capable of being heard by an unaided human auditory system. Such noise may be in the form of electromagnetic waves, or visible and near infrared light with amplitude modulation frequency content in the 0-25,000 Hz band.

The term LED as used herein may comprise any light emitting diode or light emitting structure or source capable of emitting coherent light, as in a light emitting diode laser (such as an edge emitting laser or vertical cavity surface emitting laser), or that is capable of emitting partially incoherent light, as may be found in a super-luminescent LED or, that is capable of emitting incoherent light as is found in certain light emitting diode structures.

The term photodetector as used herein may describe a single element or a multi-element (i.e., two or more) photodetector component or an array of photodetector components. Suitable photodetectors for use in the invention may comprise various photosensitive technologies such as phototranducers, photoconductors, photodetectors, and phototransistors. A photodetector as used herein may further comprise any device that is capable of generating a varying electrical signal in response to the impact and/or absorption of photons, preferably with a sensitivity in about the 300-2000 nm range.

The wavelength of the photons output by the LED and incident upon the photodetector(s) of the invention are preferably anywhere from 300 nm to 2000 nm in the optical bands, customarily referred to as the visible (VIR) or the near infrared (NIR) or the short-wave infrared (SWIR) spectrums.

The term string as used herein may describe a long, thin, taut, sound producing element used in musical instruments, including guitar and piano strings made of synthetic, metallic, or other natural materials or a combination thereof.

While a primary application of the instant invention is the accurate reproduction of the sound generated by a vibrating string of an instrument, it is expressly noted the invention is not limited to such applications and may be used in any appropriate application where the optical reproduction of a mechanical oscillation of a vibrating element is desired to be converted into an electrical signal which may comprise the vibration of a body or neck of a musical instrument.

The term amplitude modulation or "AM" as used herein refers to the physical phenomena where the intensity or amplitude of a photodetector-collected optical signal, or a LED-transmitted oscillating signal at a predetermined carrier frequency is modified by some event or action. In the present invention, the amplitude of the collected carrier frequency modulated LED light signal is modified by the vibration of the string wherein the changes in the geometric relationship of the LED and the photodetector or variances' in the LED-emitted light that is incident on the photodetector are detected with respect to the string as it vibrates.

Demodulation as referred to herein may comprise the process of signal multiplication to create a sum and difference of frequencies between two electronic signals. In the present invention, a local oscillator may be used that is approximately the same frequency as the carrier frequency of the LED signal. In the invention, the representative circuit multiplies the local oscillator signal and the phase shifted photodetector signal. The carrier frequency is preferably substantially higher than the audio and noise frequencies; e.g., preferably at least five times higher in frequency (e.g., above about 100 kHz). The result of the signal multiplication is described in the equations below that illustrate the results of frequency multiplication for a single frequency in the audio and noise spectrum:

$$f = A\sin\alpha * (B\sin(\alpha+\beta) + C\sin\gamma) = A\frac{1}{2}[B(\cos(\beta) - \cos(2\alpha+\beta)) + C(\cos(\gamma-\alpha) - \cos(\gamma+\alpha))]$$

$\alpha$=the carrier and local oscillator frequency;

$\beta$=one frequency of the string modulation spectrum;

$\gamma$=one frequency of the noise spectrum

The first term of the output following demodulation is the audio frequencies desired to be processed, heard or recorded. Assuming the carrier is much larger than the audio or noise frequencies, the following can be stated: the second term is one of the carrier feed-through terms now at approximately twice the original carrier frequency and the third and fourth terms are the noise components, now at about the original carrier frequency.

From this demodulation process, the second, third and fourth cosine terms are shifted far away from the first desired cosine term and are effectively filtered out by passing all of the signals through a suitable short pass electrical filter. The first cosine term is all that remains and represents the desired frequency content of the original string vibration. It is noted this equation is simplified and does not fully detail the true number of frequencies in the modulation nor illustrate the fact that the amplitude of each string modulation frequency may be different.

In the exemplar illustrated embodiments of the invention, the phase relationship between the detected signal and the local oscillator does not affect the mathematical principles involved but may impact the quality of the sound produced based on the integrated circuit design used for the demodulation process. The phase shift may be 0-180 degrees depending on the sound attributes of the system and, though this has an impact on the sound quality, the exact phase shift may be any value within the scope of this invention.

In the optical pickup of the invention, the fundamental principles of amplitude modulation and demodulation are applied to shift the collected desired signals out the background noise bands of about 10-20 kHz up to near 1 MHz. This is enabled by the use of the LED or laser acting as an optical source that is modulated with a carrier frequency.

The vibrating element or string may be configured to reflect (in the reflective embodiment of the invention) or variably attenuate or block (in the transmission embodiment of the invention). and thus vary the total amount of light collected on the photodetector at any instant in time. The strength of the reflected or partially blocked LED carrier signal collected by the photodetector element or elements is thereby modulated by the movement of the string by creating an interference or change in the optical path and light intensity transferred between the LED and photodetector.

FIG. 1 depicts an exemplar amplitude modulated signal comprising a carrier signal having a carrier frequency with its amplitude being modulated by a modulation signal or source.

Figure 2:
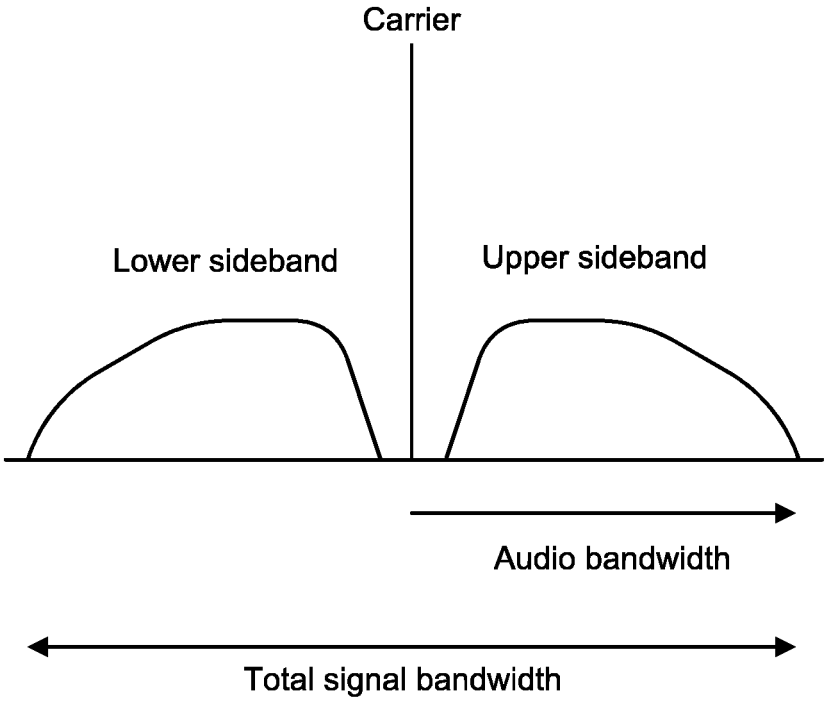
Prior Art FIG. 2
FIG. 2 illustrates an exemplar frequency content and bandwidth of an amplitude modulated signal showing a lower side band, carrier and upper sideband.

FIG. 2 illustrates an exemplar frequency content and bandwidth of an amplitude modulated signal showing a lower side band, carrier and upper sideband.

Figure 3:
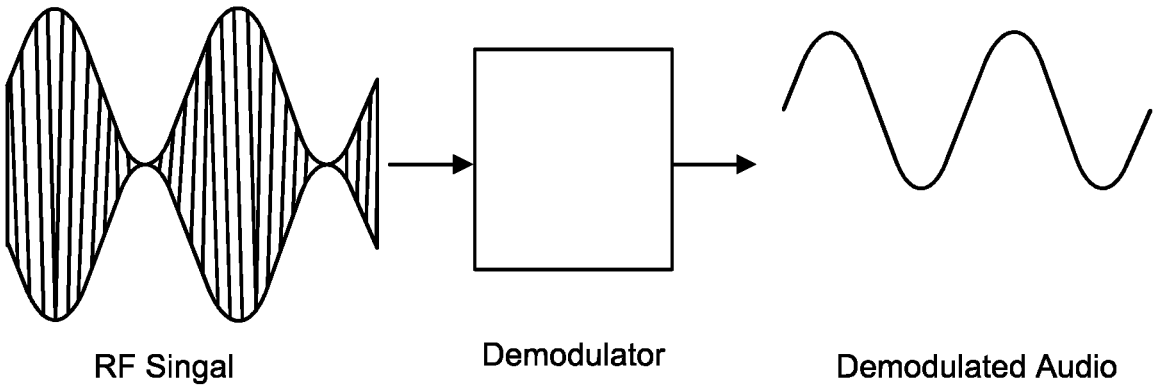
Prior Art FIG. 3
FIG. 3 shows an exemplar amplitude modulated demodulation system having an output comprising a separated sideband of the AM carrier signal that is representative of the frequency and amplitude content of an audio sound of a vibrating string of a musical instrument.
Figures 4A, 4B, 4C, 4D:
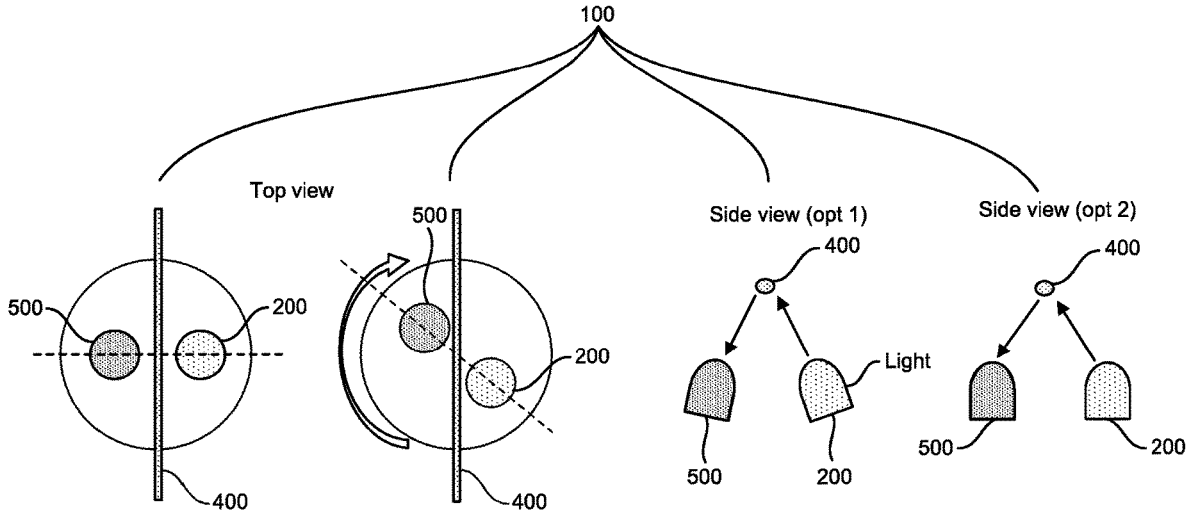
FIGS. 4A-D are representative mechanical configurations of the optical pickup of the invention with a LED light source reflecting off of a string of a musical instrument using a single photodetector per string.

FIG. 3 shows an exemplar amplitude modulated demodulation system having a demodulated output comprising a separated sideband of the AM carrier signal that is representative of the frequency and amplitude content of an audio sound of a vibrating string of a musical instrument.

As is known to those skilled in the electronic arts, the modulation of a carrier frequency amplitude generates the illustrated sidebands of the spectral content of the original carrier frequency as depicted in FIG. 3. The intensity and spectral content of these sidebands is typically about 1:1 and is proportional to the frequency content and amplitude of the vibrating string. In the invention, this is due to the mechanical arrangement of the LED optical light source that is partially reflected or partially blocked by the string, and due to the arrangement of the photodetector which collects the partially reflected or partially transmitted carrier frequency modulated LED light to convert it to a representative electric signal.

The approach of using a string of an instrument to modulate the amplitude of the carrier frequency modulated LED light optical source is referred to herein as modulation. The same photodetector(s) that is facing the string to collect the LED light is also susceptible to collecting unwanted background noise. A challenge is that both desired and undesired signals are converted into electrical signals and are added together. It can be seen that this background noise signal is added to the amplitude modulated LED signal as shown in the above equations.

Following the photodetector elements of the illustrated system is the demodulator. The demodulator is preferably configured to multiply a local oscillator (preferably nominally at the same frequency as the carrier frequency) with the photodetected signal or signals. Both the desired string amplitude modulated detected signal and the collected noise are then multiplied by the local oscillator frequency which is nominally the same frequency as the LED modulation carrier frequency. The process of multiplying these frequencies creates sum and difference frequencies between the local oscillator and each of the frequencies in the incoming signal.

If the local oscillator/carrier frequency is a frequency that much higher than the string vibration and the background noise collected, then all of the noise terms coming out of the demodulator will remain very close to the local oscillator frequency while the desired audio tones are desirably shifted back to the audio frequencies of the original string vibration frequency. By use of a simple low frequency passing electrical filter following the demodulator, the invention beneficially attenuates all of the signals near the local oscillator frequency and higher, and passes through to the musical amplifiers and recorders only the audio tones which no longer contain undesirable background noise signals.

The technique of the invention takes advantage of the fact that the string itself is the means to modulate the amplitude of the LED's carrier signal modulated optical signal. This provides an ideal way to place sidebands on the carrier frequency as illustrated in FIG. 3.

State of the art electronics allow the carrier frequency of the LED modulation optical signal to be easily in the 1 MHz range. Most known sources of light noise however are modulated in lower bands closer to the kHz frequencies. These include for instance, LED-based stage lighting and flash photography. Flashes used in photography vary but often produce pulses in the 20 us to 10 ms range with much energy in the 100 Hz to 50 kHz range. This permits a large frequency separation with the 1 MHz carrier signal such that when noise is added and subtracted from the representative 1 MHz carrier signal, the noise remains very close to 1 MHz as compared to the audio portions of the signal that are shifted back to the original 10 kHz to 20 kHz range.

In amplitude modulation theory and design, the topic of "modulation index" is a consideration. In the context of the present invention, this is related to the peaks and valleys of the amplitude modulation of the carrier signal as compared to the total amplitude of the carrier signal. In the preferred embodiment of this invention, several approaches to maximize the modulation index may be used for stronger signals and to increase the signal-to-noise ratio (SNR) of the optical pickup system.

It is well known that all electronics include noise and the present invention makes use of amplifiers and demodulator integrated circuits known to contribute some noise. Hence, a large modulation index is desirable in order to increase the desired signal amplitude over that of the noise amplitude.

There are several approaches for the mechanical arrangement of the LED optical sources and the photodetectors of the invention that can be used to achieve an acceptable modulation index with the detected string vibration. These may be broken into what are referred to herein as "transmission" and "reflective" configurations or geometries. Certain of these approaches require different electrical configurations and such electrical configurations may be defined as two types depending on whether a single photodetector is used or if dual or multiple photodetectors are used.

For single photodetectors, a single amplifier may be used but for dual photodetector configurations, a differential approach may be used to improve the signal strength and to achieve a frequency shape that more accurately represents the actual string vibration frequency. The use of a pair of photodetectors has the advantage that if some noise is present in the signal after the demodulator, this configuration subtracts the two signals from each other and acts to cancel out the noise.

Additionally, the two detectors may be positioned on opposing sides of the string and the circuit can subtract the signals from the two demodulated detector signals in order to effectively increase the signal strength. This is because, while one detector is on a positive/increasing/waxing slope of the signal change, the other detector is on a negative/decreasing/waning slope of the signal change. The difference in the two signals effectively adds the absolute values of their slopes and thus increases the total magnitude of the signal. A user may additionally utilize two LEDs, one per detector, and position them to further increase the contrast between the two signals from the two photodetectors.

In certain of the exemplary mechanical configurations herein, the optical output of the LED optical source may be directed toward the resting string positions in order to generate reflected light or light that is passed or blocked depending on the position of the static or vibrating element or string that is disposed between them. The LEDs may also have an optical output that is incident on the side of the resting string to thus reflect or pass more or less light when the string vibrates back and forth into the path of the LED light.

Likewise, one or more photodetectors may be positioned such that the light output is directed upon the resting string or to the side of the resting string. In this manner, the amount of light collected by the photodetector as the string vibrates will vary as the string vibrates in proportion to the string displacement during oscillation. In this way, amplitude modulation is imparted to the LED carrier frequency with a magnitude and frequency that is proportional to the string vibration magnitude and frequency. Suitable electronic circuitry is provided to convert the photodetector collected signal into an electrical signal and these electrical signals are then processed by demodulators and amplifiers to reproduce the string vibration frequencies and amplitudes into an electrical waveform that is proportional and representative of the string vibration.

This demodulated audio signal can then be transmitted by wire or wirelessly to an additional amplifier or audio projection equipment, such as a speaker, or to audio recording equipment for listening or storage.

Because carrier modulated LED light may be disbursed in many directions, it is advantageous to mitigate crosstalk between nearby or adjacent strings. Examples of crosstalk may include light reflecting off of one string and being detected by a photodetector that is associated with a neighboring string on the instrument. This can make it difficult to isolate sounds from each string for later amplification, transmission, modification or storage. To mitigate this, the use of multiple carrier frequencies may be incorporated or one or more different respective carrier frequencies can be used for neighboring or adjacent respective strings.

Turning again to the figures wherein like numerals designate like elements among the several views, FIGS. 4A-D show representative mechanical configurations of optical pickup 100 with LED optical light source 200 emitted light of a predetermined wavelength reflecting off of string 400 and then incident upon a single photodetector 500 per string. LED 200 and/or the photodetector 500 may be focused directly at string 400 or just to its side. The axis of the path of emitted light and photodetector 500 may be perpendicular or at any askew angle to string 400. As string 400 vibrates, the LED/photodetector 200/500 pair cooperate to produce an increasing or diminishing collection of modulated LED carrier energy, thus producing AM modulation of the carrier signal.

The centerline of LED 200 and photodetector 500 may be rotated with respect to string 400 based on the LED light emission pattern and for convenience in packaging. Further, the angle between photodetector 500 and LED 200 can be tailored for performance and manufacturability depending on a user's desired application.

Figures 5A, 5B, 5C:
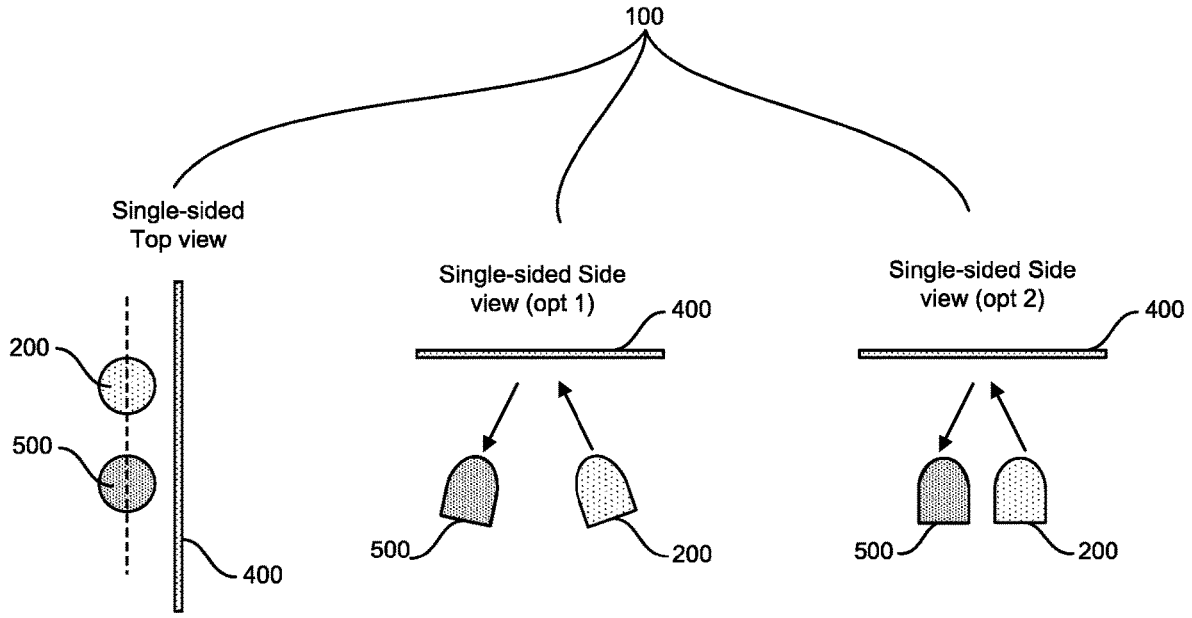
FIGS. 5A-C depict alternative mechanical configurations for the embodiments of the invention of FIGS. 4A-D wherein the LED light source reflects off of the string using a single photodetector per string.

FIGS. 5A-C show an alternative mechanical configuration of the invention with emitted light from LED 200 reflecting off of string 400 and the use of a single photodetector 500 per string 400. In this embodiment, LED 200 and photodetector 500 are substantially in line with string 400 and are focused directly at or just to the side of string 400 as shown. As string 400 vibrates, the LED/photodetector 200/500 pair produce an increasing or diminishing collection of the modulated LED emitted light carrier energy, thus producing AM modulation of the carrier signal.

Figures 6A, 6B, 6C:
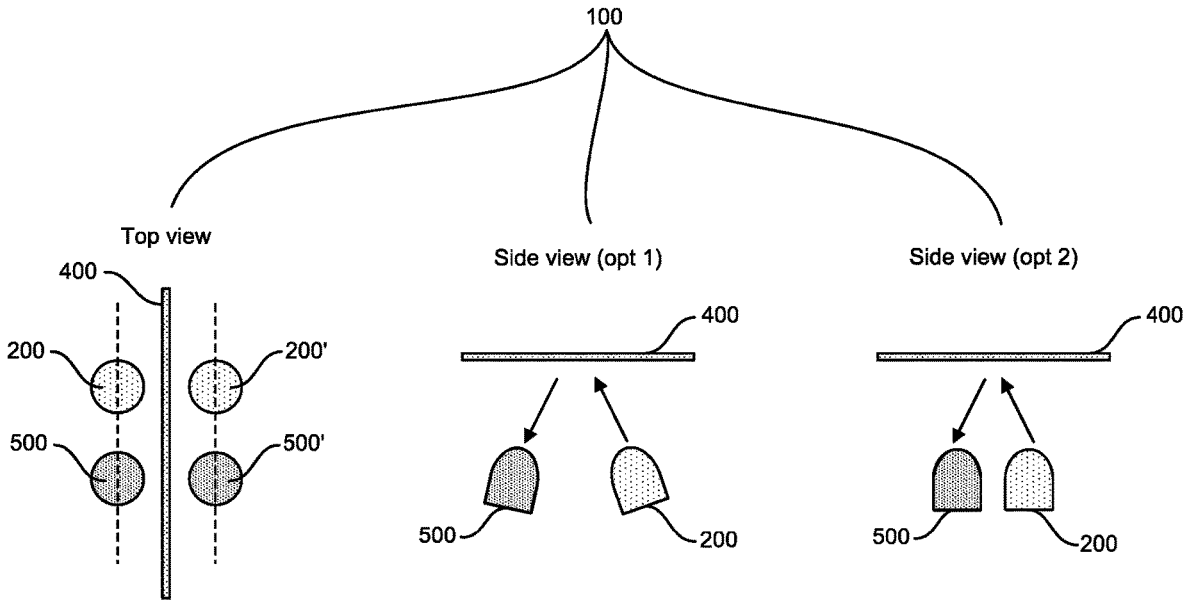
FIG. 6 is a mechanical configuration option of an embodiment of the invention wherein the LED light source reflects off of the string using a pair of LEDs and a respective pair of photodetectors.

FIG. 6 shows a further alternative mechanical configuration option using LED emitted light energy reflecting off of string 400 for the case of dual LEDs 200 and 200' and dual photodetectors 500 and 500'. LEDs 200 and 200' and/or the photodetectors 500 and 500' may be focused on the resting string 400 or to the side of resting string 400. As string 400 vibrates, each pair (i.e., the respective LEDs 200 and 200' and/or the photodetectors 500 and 500') cooperate to produce an increasing and diminishing collection of the modulated LED carrier emitted light energy, thus producing AM modulation of the carrier signal.

Figures 7A, 7B, 7C:
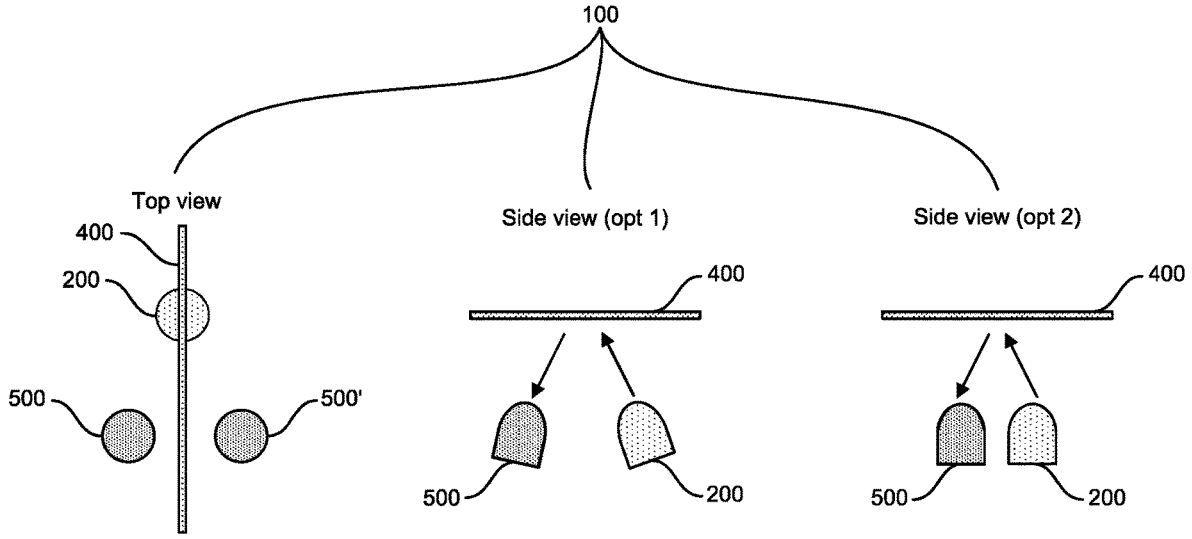
FIGS. 7A-C show mechanical configurations of preferred embodiments the optical pickup of the invention with a carrier-modulated LED light source reflecting off of the string and collected by a pair of photodetectors.

In this embodiment, the angle between the photodetectors 500/500' and LEDs 200 and 200' may be tailored for performance balanced with manufacturability and the position of one of the pairs of LEDs/photodetector may be switched for convenience and channel isolation FIGS. 7A-C show a yet further mechanical configuration of the invention with carrier modulated LED emitted light reflecting off of string 400 and collected by a pair of photodetectors 500 and 500'. As string 400 vibrates, one photodetector element in photodetector pair 500 and 500' will have increasing signal detection while the other photodetector element will simultaneously have decreasing signal detection. In this manner, the photodetector pair works with carrier modulated LED emitted light and subsequent electronics to produce an AM modulation of the carrier signal. As is illustrated, a single LED 200 and two photodetectors 500 and 500' are used. The angle between photodetectors 500 and 500' and LED 200 can be tailored for performance balanced with manufacturability.

Figure 8:
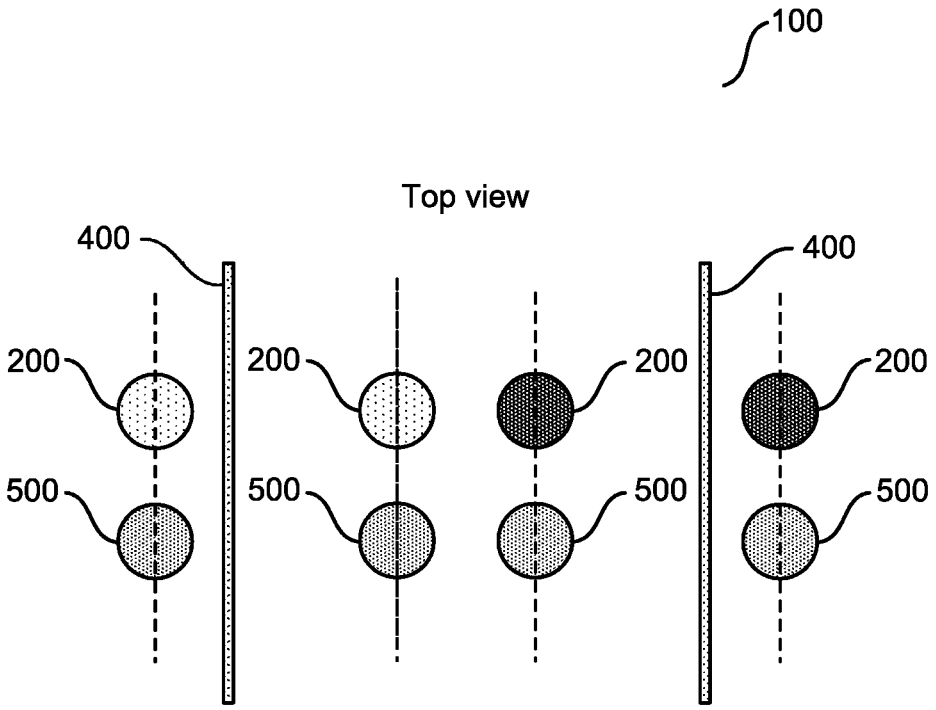
FIG. 8 illustrates an electrical and mechanical configuration of an embodiment of the instant invention comprising the use of multiple carrier frequencies for adjacent strings to prevent or minimize cross talk from undesirable reflected light from a LED/photodetector pair.

FIG. 8 shows an exemplar electrical and mechanical configuration of an aspect of the invention using multiple carrier frequencies to prevent or minimize crosstalk from reflected light from one LED/photodetector pair 200/500 from adding the signal to another LED/photodetector pair 200'/500'. The reflected light is collected but is filtered out during the electronic demodulation process. LED 200 is at a predetermined F1 first modulation frequency and LED 200 is at a predetermined second F2 modulation frequency that is different from the F1 frequency. The angle between the photodetector/LED pairs can be tailored for performance balanced with manufacturability and the position of one of the LED/photodetectors pairs can be swapped for convenience and channel isolation.

Figure 9A:
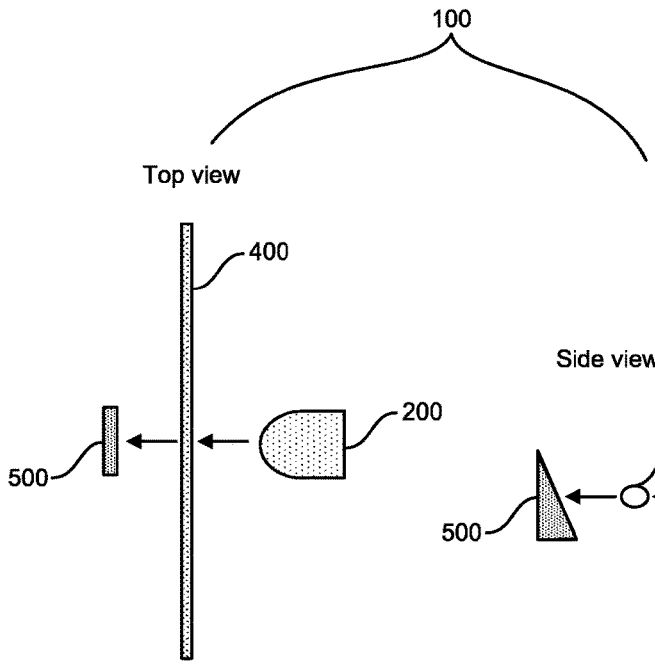
FIGS. 9A-C show certain mechanical configurations for certain preferred light transmission embodiments of the instant invention wherein a single photodetector and LED are used to accurately reproduce the motion of the string as a function of the modulation of the carrier frequency of the detected LED light source.
Figure 9B:
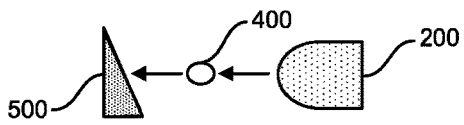
Figure 9C:
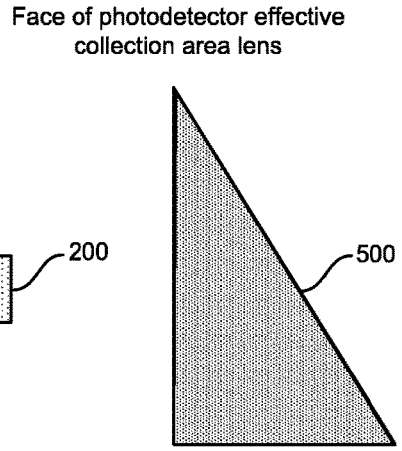

FIGS. 9A-C show a mechanical configuration for a transmission embodiment of the invention where a single photodetector 500 and LED 200 are used to reproduce the motion of the string as a modulation of the carrier frequency of the detected LED light. As the shadow generated by the movement of string 400 on opposing photodetector 500 moves, the geometrical shape of the face or input of photodetector 500 causes increasing and decreasing amounts of the optical signal to be collected by photodetector 500 that is proportional in magnitude and frequency to the string vibration largely in the plane parallel to the photodetector 500 face. LED 200 and photodetector 500 are positioned or shaped so that the amount of light from the LED 200 collected by the photodetector 500 varies as string 400 moves in relative position between LED 200 and photodetector 500.

Figure 10A:
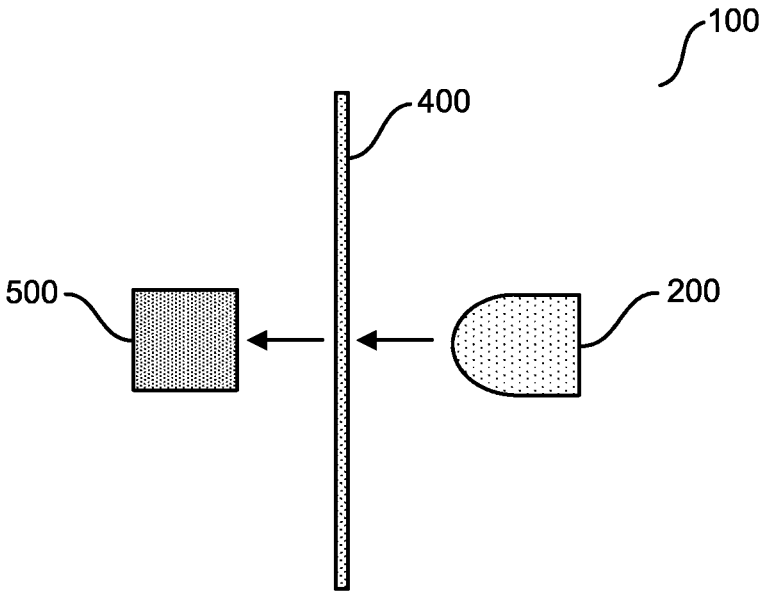
FIGS. 10A-B are certain mechanical configurations for transmission preferred embodiments of the instant invention using a pair of photodetectors.
Figure 10B:
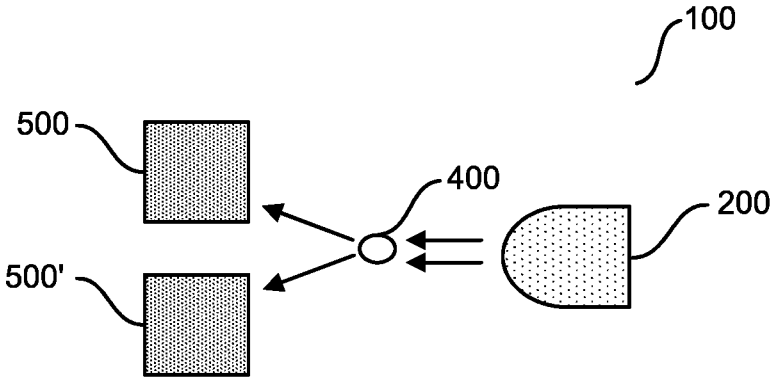

FIGS. 10A-B show an alternative mechanical configuration for the transmission embodiment of optical pickup 100 with the use of dual photodetectors 500 and 500'. Carrier frequency modulation is accomplished by the waxing and waning of the electrical signal caused by movement of the shadow of string 400 over photodetectors 500 and 500'. LED 200 and photodetectors 500 and 500' may be positioned or shaped so that the amount of light from LED 200 collected by each photodetector 500 and 500' varies as string 400 moves in relative position between LED 200 and the photodetectors 500 and 500'.

Figure 11:
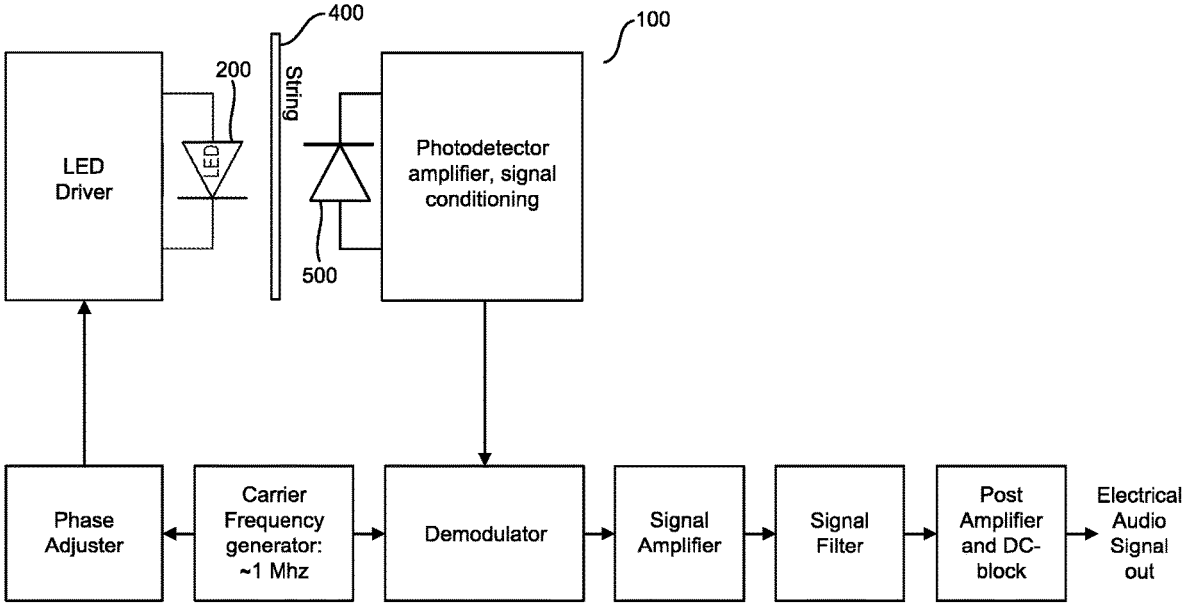
FIG. 11 illustrates a block diagram of a preferred embodiment of a circuit for use in a single string and single detector embodiment of the optical pickup of the invention.

FIG. 11 is an electronic block diagram for single string 400 and single photodetector 500 embodiment of pickup 100. The use of LED carrier modulation and demodulation permits removal of undesirable baseband noise sources that enter photodetector 500 and the photodetector amplifier electronics from continuing to the electrical audio signal output.

Figure 12:
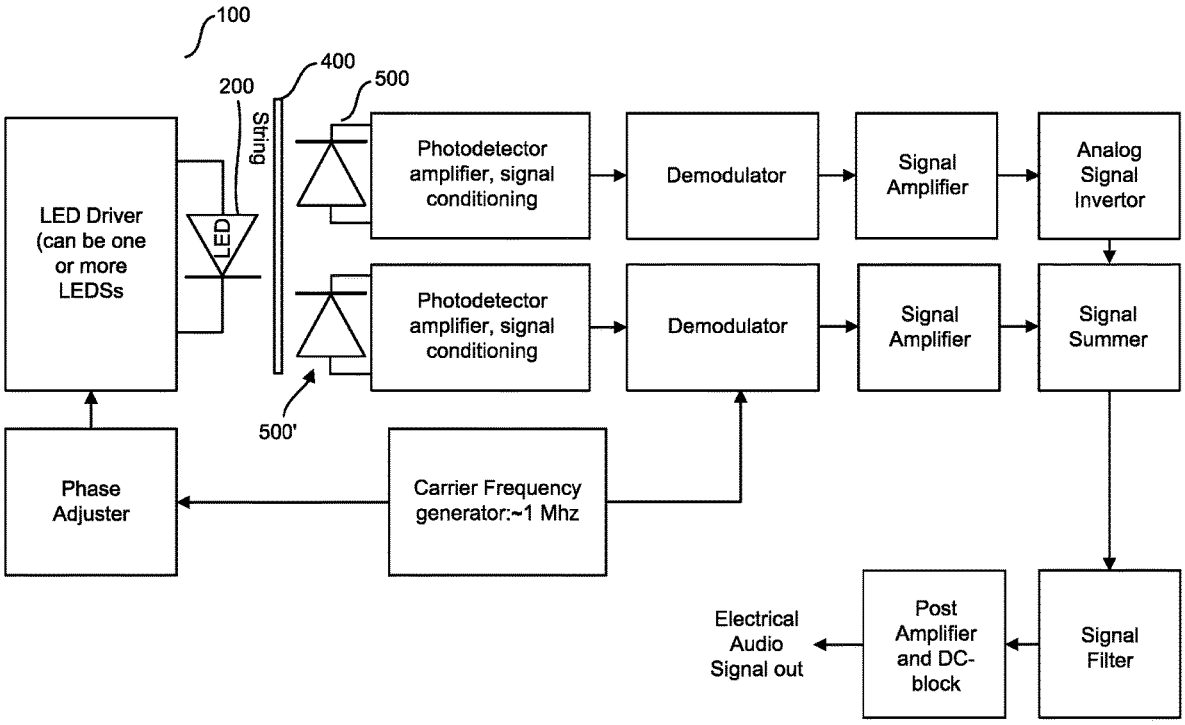
FIG. 12 shows a block diagram of an alternative embodiment of a circuit comprising the use of a pair of photodetectors of the optical pickup of the invention.

FIG. 12 is an electronic block diagram for an alternative embodiment of the invention 100 wherein dual photodetectors 500 and 500' are used for a string 400. The use of LED carrier modulation and demodulation permits removal of undesirable baseband noise sources that enter the photodetector 500 and the photodetector amplifier electronics from continuing to the electrical audio signal output. The use of a signal inverter on one signal prior to summing the two signals is a preferred means of accomplishing the signal subtraction. It is noted the proper mechanical configuration should ensure the string 400 motion causes one photodetector signal envelope to wax while the other wanes.

Different respective carrier frequencies may be incorporated for different respective LEDs that are associated with the same string. This embodiment prevents or minimizes undesired reflected light from objects such as a guitar pick, hand or finger from interfering with a second photodetector in the system. The photodetector still collects the energy from the other carrier frequency signal, but once the signal is processed in the demodulation circuit, any signal from a different carrier frequency is shifted out of the audio band. Thus, it is desirable for the different carrier frequencies to differ by more than at least 20 kHz to prevent them from being audible by a human being as best illustrated in FIG. 6 and FIGS. 7A-C.

One advantage of the use of multiple photodetectors per string is an increase in modulation depth created by subtracting the waning signal from the waxing signal as the string moves in each direction. An additional advantage in the subtraction approach is that outside noise such an optical flash lamps and reflections from a moving hand or guitar pick tend to strike both photodetectors at the same time. Thus, if the circuitry is configured to subtract the signals from each other, the noise is cancelled. This is generally referred to as "common mode rejection" in electronics and follows the principle that noise that is identical that is received by two inputs that are subtracted from each other is cancelled. In this embodiment of the invention, by providing two inputs, a user can add common mode noise rejection into the system for a cleaner sound free of unwanted noise as is best shown in FIG. 8.

To best reproduce the string vibration as a sound or recording, it is desirable to have the final electrical version of the audio signal be proportional to the string motion. In the transmission geometry of the invention, a shaped effective optical energy collection area having a predetermined geometry of a photodetector may be used to collect more light as the string moves in one direction and less as it moves in the opposite direction.

For example, if the photodetector face or input surface is masked to expose a triangular optical collection face, then as the string moves parallel to the photodetector face plane and toward the narrow point of the triangle, the LED output is incident on the larger base of the triangle, in turn producing a large amplitude on the carrier frequency. As the string moves in the opposing direction, the string blocks the light from striking the thicker base of the triangle and thus the signal collected diminishes. In this way, a single photodetector may be used to reproduce a high fidelity audio signal from the string vibration. An exemplar geometry is shown in FIGS. 9A-C.

Note that a rectangular detector can be used so long as the geometry of the LED emission pattern is configured to accomplish the effect of differential collection of the LED carrier modulated emission as a function of the position of the string between the LED and photodetector.

In the transmission embodiment of the invention, similar to the reflective mode, dual photodetectors on opposing sides of the string, as viewed from the LED position, can be used in the same fashion as the reflection modes earlier described. The signals collected by each photodetector thus wax and wane depending on the direction of travel of the shadow of the string and how much of each photodetector the shadow hits. Subtracting the two electrical signals generated by the respective first and second photodetectors after the demodulation effectively adds their magnitudes for larger modulation depth while at the same time eliminating most common mode noise as is shown in FIGS. 10A-B.

In the foregoing specification, embodiments of the invention have been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by any claims in any subsequent application claiming priority to this application.

For example, notwithstanding the fact that the elements or limitations of a claim may be set forth in a certain combination, it must be expressly understood that the invention includes other combinations of fewer, more or different elements or limitations, which are disclosed above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus, if an element can be understood in the context of this specification as including more than one meaning, then its use in a subsequent claim must be understood as being generic to all possible meanings supported by the specification and by the word itself.

The definitions of the words or elements of any claims in any subsequent application claiming priority to this application should be, therefore, defined to include not only the combination of elements which are literally set forth, but all equivalent structures, materials or acts for performing substantially the same function in substantially the same way to obtain substantially the same result. In this sense, it is therefore contemplated that an equivalent substitution of two or more elements may be made for any one of the elements in such claims below or that a single element may be substituted for two or more elements in such a claim.

Although elements may be described above as acting in certain combinations and even subsequently claimed as such, it is to be expressly understood that one or more elements from a claimed combination can in some cases be excised from the combination and that such claimed combination may be directed to a subcombination or variation of a subcombination.

Insubstantial changes from any subsequently claimed subject matter as viewed by a person with ordinary skill in the art, now known or later devised, are expressly contemplated as being equivalently within the scope of such claims. Therefore, obvious substitutions now or later known to one with ordinary skill in the art are defined to be within the scope of the defined elements.

Any claims in any subsequent application claiming priority to this application are thus to be understood to include what is specifically illustrated and described above, what is conceptually equivalent, what can be obviously substituted and also what essentially incorporates the essential idea of the invention.

What is claimed is:

1. An amplitude-modulated (AM) optical pickup system comprising:

an optical source comprising an optical signal comprising an optical signal frequency;

the optical signal frequency modified to be output at a predetermined carrier frequency to define a carrier modulated optical signal;

a photodetector in optical communication with the carrier modulated optical signal;

a vibrating element having an element amplitude and vibration frequency that is disposed in an optical path between the carrier modulated optical signal and the photodetector whereby a vibrating element vibration varies an intensity and modulates an amplitude of the carrier modulated optical signal received by the photodetector proportional to the element vibration amplitude and at the same frequency as the element vibration frequency;

whereby an amplitude modulated (AM) photodetector signal is generated by the photodetector.

2. The amplitude-modulated (AM) optical pickup system of claim 1 further comprising circuitry configured to receive and demodulate the amplitude modulated (AM) photodetector signal to provide an output signal representative of the frequency of the vibrating element.

3. The amplitude-modulated (AM) optical pickup system of claim 2 wherein the carrier modulated optical signal is incident upon the vibrating element and is reflected on the photodetector whereby an intensity of the reflected carrier modulated optical signal received by the photodetector is varied proportional to the element vibration frequency.

4. The amplitude-modulated (AM) optical pickup system of claim 2 wherein the carrier modulated optical signal is transmitted directly from the optical source to the photodetector whereby an intensity of the carrier modulated optical signal is varied proportional to a vibration frequency of the vibrating element disposed in the optical path.

5. The amplitude-modulated (AM) optical pickup system of claim 2 wherein the optical source comprises a light emitting structure, a light emitting diode or a laser element.

6. The amplitude-modulated (AM) optical pickup system of claim 2 wherein the optical source comprises a plurality of light emitting structures, light emitting diodes or laser elements.

7. The amplitude-modulated (AM) optical pickup system of claim 2 comprising a plurality of photodetectors.

8. The amplitude-modulated (AM) optical pickup system of claim 2 wherein the optical source comprises a coherent light source.

9. The amplitude-modulated (AM) optical pickup system of claim 2 wherein the optical source comprises a partially coherent light source.

10. The amplitude-modulated (AM) optical pickup system of claim 2 wherein the vibrating element comprises a string of a musical instrument.

11. The amplitude-modulated (AM) optical pickup system of claim 2 wherein a wavelength of the optical signal frequency is selected from the visible, near infrared or shortwave infrared electromagnetic spectrum.

12. The amplitude-modulated (AM) optical pickup system of claim 2 comprising at least two photodetectors per vibrating element wherein a pair of optical signals are reflected from the vibrating element and are subtracted from each other to increase a modulation depth and to remove noise common to both signals.

13. The amplitude-modulated (AM) optical pickup system of claim 2 comprising at least two photodetectors per vibrating element wherein the optical signal is transmitted from the optical source to a pair of photodetectors and a pair of respective amplitude modulated (AM) photodetector signal output signals from each photodetector are subtracted from each other to increase a modulation depth and to remove a noise common to both signals.

14. The amplitude-modulated (AM) optical pickup system of claim 2 wherein a plurality of the amplitude modulated (AM) photodetector signal output signals from multiple photodetectors are summed prior to amplification and demultiplexing/modulation.

15. The amplitude-modulated (AM) optical pickup system of claim 2 wherein a first light source comprises a first carrier modulated frequency to modulate a first vibrating element and a second light source comprises a second carrier modulated frequency that is different from the first carrier modulated frequency to modulate an second vibrating element whereby an optical signal crosstalk is reduced.

16. The amplitude-modulated (AM) optical pickup system of claim 2 wherein a predetermined geometry of an input surface of the photodetector is configured to vary an optical energy sensitivity over a surface of the photodetector.

17. A method for producing an output signal representative of the frequency of a vibrating element comprising the steps of:

configuring a photodetector to receive an optical signal comprising an optical signal frequency wherein the optical signal is modified to be output at a predetermined carrier frequency from an optical source to define a carrier modulated optical signal;

disposing a vibrating element having an element amplitude and vibration frequency in an optical path between the photodetector and the optical source wherein a vibration of the vibrating element modulates an amplitude of the carrier modulated optical signal proportional to the element vibration amplitude and at the same frequency as the element vibration frequency.

18. The method of claim 17 further comprising the step of demodulating the amplitude modulated (AM) photodetector signal to provide an output signal representative of the frequency of the vibrating element.

* * * * *